US007334794B2

(12) United States Patent
Snow

(10) Patent No.: US 7,334,794 B2
(45) **Date of Patent: *Feb. 26, 2008**

(54) POKER GAME WITH REQUIRED DEALER DISCARD

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 365 days.

This patent is subject to a terminal disclaimer.

(21) Appl. No.: 10/824,247

(22) Filed: Apr. 13, 2004

(65) Prior Publication Data

US 2005/0051960 A1 Mar. 10, 2005

Related U.S. Application Data

(63) Continuation-in-part of application No. 10/658,865, filed on Sep. 9, 2003, now Pat. No. 7,140,614.

(51) Int. Cl.
*A63F 1/00* (2006.01)

(52) U.S. Cl. ..... 273/274; 463/13

(58) Field of Classification Search ..... 273/292, 273/274, 139; 463/13
See application file for complete search history.

(56) References Cited

U.S. PATENT DOCUMENTS

| | | | | |
|---|---|---|---|---|
| 4,836,553 | A | 6/1989 | Suttle et al. | |
| 4,861,041 | A | 8/1989 | Jones et al. | |
| 5,022,653 | A | 6/1991 | Suttle et al. | |
| 5,046,736 | A | 9/1991 | Bridgeman et al. | |
| 5,098,107 | A | 3/1992 | Boylan et al. | |
| 5,174,579 | A | 12/1992 | Griffiths | |
| 5,255,915 | A | 10/1993 | Miller | |
| 5,265,882 | A | 11/1993 | Malek | |
| 5,275,411 | A | 1/1994 | Breeding | |
| 5,356,140 | A | 10/1994 | Dabrowski et al. | |
| 5,395,120 | A | 3/1995 | Malek | |
| 5,397,128 | A | 3/1995 | Hesse et al. | |
| 5,417,430 | A | 5/1995 | Breeding | |
| 5,494,295 | A | 2/1996 | Potter et al. | |
| 5,531,440 | A | 7/1996 | Dabrowski et al. | |
| 5,597,162 | A | 1/1997 | Franklin | |
| 5,639,092 | A | 6/1997 | Macaisa | |
| 5,653,444 | A | 8/1997 | Dahl | |
| 5,664,781 | A | 9/1997 | Feola | |
| 5,685,774 | A | 11/1997 | Webb | |
| 5,697,614 | A | 12/1997 | Potter et al. | |
| 5,702,104 | A | 12/1997 | Malek | |
| 5,762,340 | A | 6/1998 | Feola | |
| 5,816,915 | A | 10/1998 | Kadlic | |
| 5,845,906 | A | 12/1998 | Wirth | |
| 5,851,011 | A | 12/1998 | Lott | |
| 5,897,436 | A | 4/1999 | Singer et al. | |
| 6,012,719 | A | 1/2000 | Webb | |
| 6,027,119 | A | 2/2000 | De Lisle | |
| 6,170,827 | B1 | 1/2001 | Lombardo | |
| 6,206,373 | B1 | 3/2001 | Garrod | |
| 6,234,485 | B1 | 5/2001 | Perkins | |
| 6,237,916 | B1 | 5/2001 | Webb | |
| 6,334,613 | B1 | 1/2002 | Yoseloff | |
| 6,345,823 | B1 | 2/2002 | Webb | |
| 6,379,245 | B2 | 4/2002 | De Keller | |
| 6,402,148 | B1 | 6/2002 | Saruwatari | |
| 6,467,771 | B1 | 10/2002 | deKeller | |
| 7,140,614 | B2 | 11/2006 | Snow | 273/274 |
| 7,165,770 | B2 | 1/2007 | Snow | 273/292 |
| 7,195,243 | B2 | 3/2007 | Kenny et al. | 273/292 |
| 2002/0113371 | A1 | 8/2002 | Snow | 273/292 |
| 2002/0175468 | A1 | 11/2002 | Kenny et al. | 273/274 |
| 2002/0195775 | A1 | 12/2002 | Webb et al. | 273/292 |
| 2004/0041346 | A1 | 3/2004 | Snow | 273/292 |
| 2004/0061288 | A1 | 4/2004 | Snow | 273/274 |
| 2004/0075215 | A1 | 4/2004 | Snow et al. | 273/292 |
| 2004/0084843 | A1 | 5/2004 | Snow | 273/292 |
| 2004/0090003 | A1 | 5/2004 | Snow | 273/274 |
| 2004/0090005 | A1 | 5/2004 | Snow | 273/292 |
| 2004/0150163 | A1 | 8/2004 | Kenny et al. | 273/292 |
| 2004/0217548 | A1 | 11/2004 | Snow | 273/292 |
| 2005/0029741 | A1 | 2/2005 | Snow et al. | 273/274 |
| 2005/0051958 | A1* | 3/2005 | Snow | 273/274 |
| 2006/0119044 | A1 | 6/2006 | Kekempanos et al. | 273/292 |
| 2006/0186599 | A1 | 8/2006 | Kenny et al. | 273/292 |
| 2007/0080497 | A1 | 4/2007 | Kenny et al. | 273/292 |

* cited by examiner

*Primary Examiner*—Vishu K. Mendiratta
(74) *Attorney, Agent, or Firm*—Mark A. Litman & Associates P.A.

(57) ABSTRACT

A poker-type card game comprises at least one player making at least one ante wager in the poker-type game at least against a dealer/banker's hand. The player receives a first number of cards and the dealer receives a second number of cards that is at least one card more then the number of cards received by the player. A set of community cards is provided that are used by the dealer and the player. One of the dealer's cards is exposed to the table to provide an exposed dealer card. The dealer is compelled to discard the exposed dealer's card if the rank of the exposed dealer's card is within a first range of values and the dealer is compelled to discard an unexposed dealer's card if the exposed dealer's card is within a second range of values. After resolving the status of the dealer's hand, the player may be allowed to amend the initial one ante wager. The player may also make two separate ante wagers, one of which may be withdrawn upon seeing the dealer's up card or the resolution of the discard and retention requirements by the dealer. Different amounts and proportions of Second Ante wagers and/or Play Wagers may be made on the respective ante wagers, such as 1×, 1.5×, 2×, 3× or more with respect to the amount of the first ante wager.

20 Claims, No Drawings

POKER GAME WITH REQUIRED DEALER DISCARD

RELATED U.S. APPLICATION DATA

This Application is a continuation-in-part application of U.S. patent application Ser. No. 10/658,865 filed Sep. 9, 2003 and titled "POKER GAME WITH REQUIRED DEALER DISCARD," now U.S. Pat. No. 7,140,614.

BACKGROUND OF THE INVENTION

1. Field of the Invention

The present invention relates to a method of playing a wagering game, particularly a casino table card wagering game or a player banked casino table card wagering game. The invention relates to such games that can use standard rules of poker rank and preferably a standard deck(s) of playing cards. More specifically, the method of the present invention is an enhancement to a game of poker by having a dealer or banker provided with one or more rule restrictions that has a strategic effect in play of the dealer's hand or banker's hand.

2. Background of the Art

Many different wagering games presently exist for use in both home and casino environments. Such games should necessarily be exciting, uncomplicated and easy to learn so as to avoid frustrating the players. Card games such as poker and Twenty-One have gained widespread popularity because of their established ranking of hands and well-known rules. Furthermore, each of these games usually involves numerous wagering opportunities for the players, thus increasing player participation and excitement. Lastly, the games move fairly quickly to maintain action and activity. All of these factors have created games that are widely accepted and widely known.

Variations in wagering structures can also increase the excitement and acceptance of such wagering games. Breeding, U.S. Pat. No. 5,417,430 discloses a poker game with an altered wagering scheme thus allowing the player the opportunity to compete for an additional prize or payout.

Other variations can be made to standard games to allow more player opportunity and involvement. Boylan et al., U.S. Pat. No. 5,098,107 discloses a game wherein additional symbols are added to increase wagering opportunities. This allows the player the opportunity to place several wagers on different aspects of the game while the game is being played.

Many variations in the play of poker-type games have been introduced to increase the excitement and interest in the play of both table and video versions of poker. For example, in a video version of draw poker, Dabrowski et al., U.S. Pat. Nos. 5,356,140 and 5,531,440 teach that after an initial wager, two distinct hands may be dealt, and the player may select between the two hands for continued play of the game. Only a single hand may be played.

Lombardo et al., U.S. Pat. No. 6,170,827 describes a casino table card game in which a greater number of cards are provided to a dealer than to a player. The player provides a first stake and designates a portion of his lesser number of cards to correspond to that first stake. The cards dealt to a player (e.g., 4 initial cards) are split into two hands, each of which has a separate stake, and each of which plays against two hand segments established by the dealer. The player may also rearrange cards in the first segment, if the player's hand ties the dealer's hand.

Suttle et al., U.S. Pat. No. 4,836,553 describes the basic play of Caribbean Stud® poker. A five-card hand is dealt to each player and to a dealer after an ante is placed by each player. One card from the dealer's hand is exposed, and the player may place a wager that is a multiple (typically 2× the Ante) to stay in the game after viewing the dealer's exposed card. Bonus bets are paid in this game, only when the player attains a ranked hand and beats the dealer's hand.

Webb, U.S. Pat. No. 5,685,774 describes a casino table poker game in which separate bets may be placed by a player that a player's hand will either exceed a predetermined rank or beat the dealer's hand. At least one, but not necessarily both bets may be placed. A third optional bet is available that backs up the wager as to whether the player's hand will exceed the rank of the dealer's hand. Wild cards are available, and an initial hand of three cards may be dealt to the player.

Webb, U.S. Pat. No. 6,012,719 describes the basic game of three-card poker, which combines the play of Blackjack, a three-card poker wager, and a side bet. A dealer's card is combined into the player's first two cards for the three-card poker play.

Lott, U.S. Pat. No. 5,851,011 describes a poker-type game with multiple wagers, jackpots and insurance options. Multiple players wager on a single five-card player hand which competes against a seven-card dealer hand from which five dealer cards are selected to form a dealer's hand.

De Lisle, U.S. Pat. No. 6,027,119 describes a method of playing a card game (non-poker type) wherein players' and dealer's hands are evaluated by determining the suit (in each hand) where the player's and dealer's 'points' are highest. There are optional call bets at various points of hand disclosures.

Singer et al., U.S. Pat. No. 5,897,436 describes a modified poker game in which a player builds a hand, being dealt two cards at a time and discarding one card at a time, until a hand is built of a predetermined number of cards.

Garrod, U.S. Pat. No. 6,206,373 describes a method of playing a card game with a dealer's hand that has a permanent displayed card (e.g., the Ace of Spades). From the remainder of the deck, each player is dealt two facedown cards, and each player may act on their cards, being given an option to continue or fold and receive a portion of the wager back. Then five common cards are dealt face up, with the common cards being common to both the dealer's and the players' hands. Players may receive awards for bonus hands.

Perkins, U.S. Pat. No. 6,234,485 allows a player to purchase a bonus card in the play of a casino table poker game, the card being delivered when the first five cards is a losing hand.

Wirth, U.S. Pat. No. 5,845,906 teaches the potential for the option of using a sixth card in a dealer-vs. -player casino table poker game.

Miller, U.S. Pat. No. 5,255,915 describes an electronic six-card poker hand, with an option of drawing cards available, and an optional sequence of wagers. This game does not utilize shared common cards or rules for dealer card retention and discard.

Shuffle Master, Inc.'s pending application, U.S. Ser. No. 10/277,508 filed Oct. 21, 2002, entitled: Poker Game with Bonus Payouts describes a game in which a player may get additional cards when the player's hand has a low value.

de Keller, U.S. Pat. Nos. 6,379,245 and 6,467,771 describe a casino table poker game in which players may be provided with community cards and given an opportunity to increase their wagers. The game requires the use of a common pot in the play of the game and there are no fixed rules on card retention or discarding.

Saruwatari, U.S. Pat. No. 6,402,148 describes a player versus dealer and pay table poker game in which a player makes two distinct wagers (one wager against the dealer for a high card wager and a second wager against the pay table) and the player receives one card and the dealer receives one or two cards. The player and dealer cards are combined to form a poker hand competing against the pay table for all players who have made the pay table wager.

Garrod, U.S. Pat. No. 6,206,373 describes a card game in which players compete against a dealer, with the same common cards for both the dealer hand and players' hands. The player may fold and receive a portion of the wager back when a specific card (e.g., a deuce) is present in the player's initial two cards. The options on dealer card retention and the rules for bet withdrawal are different from those in the present game play method.

Similarly, Kadlic, U.S. Pat. No. 5,816,915 describes a video poker gaming apparatus in which multiple hands are displayed on a screen and each of the hands is partially revealed (e.g., 1 or more cards, but less than all cards are displayed). The player then elects which one of the multiple displayed hands is to be played, and the draw poker game or stud poker game for that one hand proceeds to a resolution. Again, only a single hand of poker is player.

Malek, U.S. Pat. Nos. 5,265,882; 5,395,120 and 5,702,104 teach a casino table card game apparatus and play in which each player's position is provided with three distinct card playing areas or lines. Cards are dealt to a player so that each player may play at least two distinct card games (e.g., from among Twenty-One, modified Draw Poker, and Baccarat). A player makes a first bet in at least two of the different player positions, and cards are dealt to each of those player positions. Different games are played with each separate set of hands, and the play of one game does not directly influence or affect the play of any other game.

Similarly, Macaisa, U.S. Pat. No. 5,639,092 describes a method of playing a casino table game having multiple casino games. Each player position is provided with distinct playing positions for the different games (such as blackjack, roulette, baccarat, poker and jackpot).

Potter et al., U.S. Pat. Nos. 5,494,295 and 5,697,614 describe a casino table card game and apparatus in which a player may select any number of predetermined hand ranking rules to apply to the play of a hand. A player is dealt an initial, partial hand, and the player then elects from that initial hand which set(s) of predetermined hand ranking rules apply to the hand. In a preferred game, the dealer receives two separate bank hands, one that utilizes the hand ranks of standard poker and one that utilizes the hand ranks of low-ball poker. Once each player has received four of his five cards, each player decides which of the dealer's two hands to play against, with the option of playing against both (as in selecting both ways in a Hi-Low poker game). Then each player receives his or her fifth, and last, card. At this point, the "bank" hands are exposed and each player's hand is compared to the specific "bank" hand, or hands, that they played against, winners are determined, and wagers are settled. The election of playing against a high rank hand, low rank hand or both hands, does not alter the strategy or selection of cards, as only the hand dealt to the player is utilized, without any replacement of cards coincident with play strategy.

Feola, U.S. Pat. No. 5,664,781 describes a method and apparatus for playing a poker-type card game. A number of different stud poker hands are dealt on a playing surface and players wager as to which will have the highest stud poker ranking. Game options include choosing the hand with the lowest rank instead of the highest rank. As each hand is fixed and there are no replacement cards, there can be no play of one hand that is influenced by the play of another hand. There is no dealer hand against which a player competes.

Lombardo, U.S. Pat. No. 6,170,827 describes another poker-type casino table card game. This game may be played at a table with as many as seven players competing against a dealer. The play of the game has each player having multiple hands and using a dealer's card. One method of play is to provide each player with three cards, and the dealer is provided with four cards. The dealer's play of cards is predetermined, while the players may select their desired holding. Player's hands are competing directly against the dealer's hand in each of the hands made by the player and the dealer.

Yoseloff, U.S. Pat. No. 6,334,613 describes a play of a hand of poker (either as a casino table card game or a video gaming apparatus or computer game), in which a partial hand is provided to a player after initial wager. The actual hand of poker involves the potential for at least two distinct games of poker being playable from that partial hand. The player may then elect to play one or more of the potential games from at least two distinct games of poker available for play with that hand. At least two of the games, which may be played from the partial hand, require decisions in one poker game that is intended to positively affect the outcome in one game, but is likely to have a negative effect in the play of the second game. Various pay tables are provided that differ from each other, with respect to each single game, depending upon whether the player elects to play a single game with the partial poker hand or elects to play at least two games with continued play of the partial poker hand.

Webb, U.S. Pat. Nos. 6,345,823 and 6,237,916 describe a three-card, four-card, or five-card poker game in which various wagers are available to be made on the play of each player's hand.

The game of Caribbean Stud™ poker is described in Suttle, U.S. Pat. No. 4,836,553 (previously described) and Jones et al., U.S. Pat. No. 4,861,041. That game basically comprises a card game in which a player and a dealer are each dealt five cards. If the dealer has a poker hand having a value less than Ace-King combination or better, the player automatically wins. If the dealer has a poker hand having a value of an Ace-King combination or better, then the higher of the player's or the dealer's hand wins. If the player wins, he may receive an additional bonus payment depending on the poker rank of his hand. In the commercial play of the game, a side bet is usually required to allow a chance at a progressive jackpot. In Caribbean Stud™ poker, it is the dealer's hand that must qualify. As the dealer's hand is partially concealed during play (usually only one card, at most, is displayed to the player before player wagering is complete), the player must always be aware that even ranked player hands can lose to a dealer's hand and no bonus will be paid out unless the side bet has been made, and then usually only to hands having a rank of a flush or higher.

Another poker variant played in private games is called "Pitch and Bitch" poker. The normal play of the game is for each player to place an ante bet (the dealer usually being only a random player at the game) and then each player receives five cards in stud fashion (e.g., a] one card down, the next four cards up; or b] two cards down, three cards up), with betting taking place after the second card, the third card, the fourth card and the fifth card. After all five cards have been dealt, any player may pay an amount (usually equal to the ante) to allow that player to discard a card and receive a replacement card, in the same manner as the card replaced (i.e., a replacement down card for an original down card and a replacement up card for an original up card. Another round of wagering then takes place after the replacement card has been offered (and accepted or declined) to each player.

The availability of additional or alternative games of play and especially poker with alternative features is desirable in the field to stimulate and maintain player interest.

SUMMARY OF THE INVENTION

A poker-type card game comprises at least one player making at least one ante wager in the poker-type game at least against a dealer's hand. The player receives a first number of cards and the dealer receives a second number of cards that is at least one card more then the number of cards received by the player. A set of community cards is provided that can be used by the dealer and the player. One of the dealer's cards is exposed to the table to provide an exposed dealer card. The dealer is compelled to discard the exposed dealer's card if the rank of the exposed dealer's card is within a first range of values and the dealer is compelled to discard an unexposed dealer's card if the exposed dealer's card is within a second range of values. After resolving the status of the dealer's hand, the player may be allowed in some circumstances to modify the initial one ante wager. The at least one ante wager and any modification to that wager is then resolved according to rules of the poker type game, with the dealer and the at least one player forming multiple-card poker hands from a) the community cards and dealer's cards and b) the community cards and the at least one player's cards.

The player may also make two separate ante wagers, one of which may be withdrawn upon seeing the dealer's up card or after the resolution of the discard and retention requirements by the dealer. Different amounts and proportions of Play Wagers may be made on the respective ante wagers, such as 1×, 1.5×, 2×, 3× or more with respect to the amount of the ante wager. An additional side bet against a pay table may be made, or a side bet against a three-card poker hand provided by the community cards may be made.

DETAILED DESCRIPTION OF THE INVENTION

A card game (either in casino table version, player-banked version or video version) is played with at least one player hand competing against one dealer hand. In a player-banked version, one of the players is the banker and all other players play against the player-banker's hand as if that player were the dealer in a standard casino table game. The dealer's hand of cards is the banker hand, and the banker does not have cards in his/her playing area while that player banks the game. The player must make at least one play wager in the card game. A first number of cards, X, (e.g., 1, 2, 3, 4, 5, 6 or 7 cards, preferably 1, 2, 3 or 4 cards, more preferably 1, 2 or 3 cards) are dealt to a player, and a second number of cards, X+n, are dealt to a dealer (or virtual dealer), with at least one of the n dealer cards being exposed. Preferably n=1 and should not exceed 2. A plurality of community cards are dealt face down on the table, with a large enough number of community cards dealt to at least complete a hand for a target number of cards for the competition between the player's hand and the dealer's hand. The same community cards will be used by both all of the players and the dealer.

A "player-banked" game operates with essentially the same rules as a standard casino table game, but a player is randomly selected then elects or is elected to bank payments in a round of play, as if the player were the house. Various methods are used by casinos to choose a banker, including random selection and taking turns in order. For example, when a game is offered in a California card room, players bank the game. In order for players to feel they can afford to bank a particular game, the payout odds must be kept low enough to prevent players from avoiding their turn banking the game. The higher bonus payouts are therefore preferably eliminated in player-banked versions of the invention. Higher payout odds are acceptable in a more traditional Las Vegas style casino where the house banks the game. Jackpot or super-bonus payouts are therefore usually eliminated in player-banked games, or separate wagers of the jackpot type may be funded by side wagers to the house or to a progressive jackpot.

In the player-banked version, the game is played as a method of playing a player-banked poker-type card game. At least one player makes at least one ante wager in the poker-type game. Each player in the game and a banker places at least one ante wager to participate in the game. At least one player receives a first number of cards as a partial player hand and a dealer receives a second number of cards as a partial banker hand. The second number of cards received by the dealer has at least one card more then the first number of cards received by the player. The first number of cards and the second number of cards form partial player hands and a partial banker hand, respectively. That is, the second number of cards received by the dealer comprises the banker's partial hand. The dealer provides a set of community cards that are used by the banker and the at least one player to complete the partial banker hand and partial player hands. The dealer exposes one of the banker's cards to provide an exposed banker card. The dealer is compelled to discard the exposed banker's card if the rank of the exposed banker's card is within a first range of values (e.g., described further herein). The dealer is compelled to discard an unexposed banker's card if the exposed banker's card is within a second range of values that is different from the first range of values. (The second range is preferably lower than the first range in rank). In one form of the invention, if the dealer's up card is within a third range of values or a particular value such as an Ace, the dealer is not required to discard a card. A preferred third value is an Ace. This compelled hand formation is a step in determining a rank of the banker's hand. The at least one ante wager is then resolved according to rules of the poker-type game (with or without additional wagers, side bets or wager modifications according to the rules of the game). The dealer and the at least one player form a multiple-card banker poker hand and player poker hands from a) the community cards and banker's cards and b) the community cards and the at least one player's cards, respectively. Preferably the dealer makes his best hand from the available cards and the players use all cards to make their best hand.

According to one aspect of an embodiment of the invention, the dealer examines the up card in the dealer's hand of X+n cards. According to rules in the game, any first exposed card with a rank within a predetermined range must be discarded or kept. When the exposed card must be kept according to the rules of the game (being within a range of rank that determines that a card must be kept), then a hole card is discarded, with or without being shown to the table (the players and the dealer). If n=1, and the exposed card is discarded, the rules of the game may call for or deny exposure of another dealer's card. If n=2 and the first exposed card is discarded, then a second card will be exposed and considered for discard under the same rules as the first exposed card or with different rules for the second exposed card. In this manner, the dealer/banker hand is compelled to discard at least one card from the initial partial dealer/banker hand. The card to be discarded is determined according to strict rules that do not allow the dealer/banker to exercise any judgment in the selection of what card is to be discarded or how many cards are to be discarded. The rules may also dictate which down card is to be discarded, to further eliminate any exercise of choice or options by the dealer/banker. For example, the rules may require that, if a down-card is to be discarded, the down-card selected must either be the first dealt down-card, the last dealt-card, or some other specifically located down-card.

In another alternative and preferred aspect of the present invention, the player is allowed to make two distinct wagers at the beginning of the game, a Play Ante and a Big Raise Ante Wager. These two distinct ante wagers are placed on designated wager positions at each player location. The two distinct ante wagers may be of equal value or of unequal value within game limits. That is, if the maximum table wager is $1,000 and the minimum is $10.00, one ante wager may be $10.00 and the other ante wager may be $1,000.00. The house rules may further limit the relative size of the two ante wagers to, for example, 3×, 5× or 10×another ante wager. With a 5×house rule in effect, therefore, a $100.00 first ante wager would allow only a $500.00 second ante wager, even though the table maximum of $1,000.00 has not been reached. One exemplary house rule is to limit the Big Raise Ante Wager to a multiple of the ante, such as 1×, 2×, 3×, 4× or 5× the Ante. In one form of the invention, the player will have the option of increasing the initial ante wagers (either one or both according to the house rules) by a 1×, 2×, 3× or higher Play Wager. The rules may also allow a range of Big Raise Ante Wagers to be placed by each player, at the option of the player, rather than having a fixed multiple of the Ante for the Big Raise Ante Wager required. The player in one form of the invention has the exclusive option of selecting the size of the multiple wager, choosing between the available multiples (without the house or banker specifying a specific multiple as a required raise). In the player-banked game, the banker may have the ability to specify the multiple size of the Big Raise Ante Wager or limit the size of that wager (as may be necessitated by funds remaining on the table for that player/banker).

When the player places an Ante and Big Raise Ante, the player will have the option of withdrawing one of the two wagers (either only the larger wager, only the smaller wager, or able to select between the two wagers) after the dealer completes the discard and/or retention of cards. This rule may be further qualified, and this is a preferred qualification, that if the Dealer displays a predetermined specific value of card, such as a King or an Ace (or other specific ranks, such as a Queen or Jack or 10; etc.), the player must leave both initial Ante wagers in play. This format gives the player some potential for greater flexibility over wagers. The rules may also allow or require the player to have to make a Play wager equal to at least 1× the ante wager to be able to withdraw the other ante wager. This is still advantageous to the player, for example, where the first ante wager was $5.00, the second ante wager was $15.00, and the required Play Wager to enable withdrawal of the second wager is $5.00. This would allow the player to reduce the amount of money in play from $20.00 to $10.00 where the player has reduced confidence in a winning outcome.

Payouts on the ante wager and the Play Wagers are usually at 1:1 in competition against the dealer. Automatic bonuses (e.g., not requiring a separate bonus wager) for higher ranking hands on ante wagers or Play Wagers are optional in the present game outside of any side bet wagers that are provided.

The rules for discarding a dealer's exposed card(s) can be selected from a number of ranges of rules for this feature. For example, the dealer's first up card can be selected from rules such as shown in the following table in a high hand poker-type game.

TABLE 1

| Rule No. | Must Retain | Must Discard |
|---|---|---|
| 1 | Rank of 10 or Higher | Rank of 9 or Lower |
| 2 | Rank of 9 or Lower | Rank of 10 or Higher |
| 3 | Any Spade | Any Heart, Diamond or Club |
| 4 | Any Spade or Club J, Q, K or Ace | Any other card |
| 5 | Any Card Other then a Spade or Club J, Q, K or Ace | Any Spade or Club J, Q, K or Ace |
| 6 | Any Randomly displayed rank, minimum rank, or maximum rank | The inverse ranking set of the retained cards |
| 7 | A ranking set dependent upon a side wager | The inverse ranking set of the retained cards |

In one example of the invention, the players receive two cards and the dealer is dealt three cards (X=2, n=1) in one dealer hand, with one dealer card exposed. If the exposed dealer card is 9 or lower, the dealer must discard that card. If the card is 10 or higher, the dealer retains that card and discards another card from his hand. The game then proceeds. The discard and retention rules may apply to the dealer's up card, as well as the dealer's down cards. In a low-ball game, the range for discards may be changed so that the dealer would have to discard more favorable low cards (e.g., Ace, 2, 3, 4, or 5, and the Ace may be retained according to one format of play). In another example of the invention, if the dealer's up card is a predetermined minimum ranking (i.e., 10) or higher, the dealer must instead discard a down card. If the card is a third ranking or higher, such as an Ace or King, for example, the dealer is not required to discard any cards. The dealer then makes his best five-card hand with all available cards, including the community cards.

The rules for discarding and retention of any second exposed dealer cards can be the same (in the same game) or different (in the same game) as the rules for retention and discard of the first dealer exposed card (e.g., when X=2 and n=2). The game has a particular level of interest where the rules are reversed, as where a maximum rank (e.g., 9 or lower) must be discarded on the first card, and a minimum rank (e.g., 10 or higher) must be discarded with a second dealer exposed card. If wild cards are included in the deck, the game may require or prohibit discarding of the wild card irrespective of the rank limit rules for discard and retention. Side bets or side wagers may be placed against a pay table on either a player's hand or a dealer's hand or both. The typical side bet against a pay table being that a hand will achieve a rank of at least a predetermined wager, the hand paying off increasing odds depending upon the rank of the hand actually achieved. Additional wagering may be made on the game after the dealer hand has been determined (as to the number of cards and which cards will be present).

The following examples of hands played will further enhance the enabling description of the present invention and exemplify some, but not all, of the possible and alternative elements of play of the game.

EXAMPLES

Example 1

From a standard 52-Card deck, four player hands are dealt two cards each (face down) at a table where each of the four players have placed a $5.00 ante wager on their individual hands. The dealer is dealt three cards face down, and one card is turned face up, with these cards representing the player-banker's partial hand for a fifth player. Three community cards are dealt face down. Rule 1 of Table 1 is used in this Example. The dealer's first up card is a 6 of Diamonds. According to the rules of play in effect, this card must be discarded. The dealer's partial hand therefore has two cards face down. The players can examine their individual hands and make independent decisions on whether they want to fold (losing their $5.00 play wager) or make a play bet to stay in the game. In this Example, the play bet is limited to 1×, 2× and 3× the original play wager.

Player 1 has hole cards of 6 of Clubs and 4 of Diamonds. Good strategy would suggest folding since one six has been displayed and discarded by the dealer and one diamond has been similarly displayed and discarded. Player 1 therefore folds.

Player 2 has a Jack of Hearts and King of Diamonds. These cards have not been significantly adversely impacted by the discard of the 6 of Diamonds, and they are cards of a reasonable rank, but of no clear ability to win against even a low-ranking winning hand. Player strategy would suggest staying with a minimum additional Play Bet of $5.00.

Player 3 has a 10 of Diamonds and a 10 of Spades. These cards and the potential for the hand have been minimally impacted by the discarded dealer's card, and the rank of the hand is already relatively good for a five-card stud poker hand. The player would elect to place a Play Bet of 2× or 3× the Ante Wager. Here in the Example, a $15.00 Play Bet (3× the Ante) is made.

Player 4 has an Ace of Clubs and King of Clubs. These cards and the potential for the hand have been minimally impacted by the discarded dealer's card, but the rank of the hand is still not established for a five-card stud poker hand. The player, being an optimist, places a 2×Play Bet, or $10.00 Play bet on the hand.

Either the dealer's cards or the community cards can be revealed first at this time. The community cards are exposed to show a Q of Clubs, J of Clubs and 10 of Clubs. This provides a final hand rank of a pair of Jacks for player 2 (Player 1 has already folded), Three-of-a-kind (three 10's) for Player 3, and a Royal Flush for Player 4. All of the players have an expectation of a possible win against the dealer/banker hand.

The dealer/banker hand is revealed as a Q of Hearts and Ace of Diamonds. The dealer's best hand is therefore a pair of Queens. With this final hand determination, Player 1 has lost (he folded), Player 2 loses with a pair of Jacks against the higher pair, and players 3 and 4 win their individual wagers with three 10's and a Royal Flush, respectively. The player-banker would then resolve the wagers. If there are any bonus payments for high ranking player hands or any side bets on high rank player hands, those wagers would also be settled at this time.

Example 2

In this example, from a standard 52-Card deck, four player hands are dealt two cards each (face down) at a table where each of the four players have placed a $10.00 wager on their individual hands. Each player has also made a side bet against a pay table. The dealer is dealt four cards as the player-banker's hand—three cards face down, and one card is turned face up. Three community cards are dealt face down. Rule 2 of Table 1 is used in this Example. The pay table is shown below:

| Hand | Payback Odds |
|---|---|
| Royal Flush | 1000:1 |
| Straight Flush | 250:1 |
| Four-of-a-Kind | 100:1 |
| Full House | 20:1 |
| Flush | 7:1 |
| Straight | 5:1 |
| Three-of-a-Kind | 3:1 |
| Two Pair | 2:1 |
| Pair (Jacks or Better) | 1:1 |

For simplicity in payout analysis, this example will use the final hands of the dealer and Players 2, 3 and 4 in Example 1. Initially, however, the Ace of Spades was the dealer's first exposed card and that was discarded according to the force of Rule 2. The dealer reveals a second card that is a King of Hearts and it is also discarded according to Rule 2, leaving a two-card partial hand for the dealer. Both cards are face down.

In the game, Player 2 still loses the Play Wager, but gets paid 1:1 on the side bet with a pair of Jacks. Player 3 wins the Play Wager and the Play bet at 1:1 odds, and wins $15.00 on the side bet with the Three-of-a-kind hand. Player 4 wins the Play Wager and the Play bet at 1:1 odds, and wins $5000.00 on the side bet with the Royal Flush.

Example 3

This example will be played with Rule 6 from Table 1 in effect. A separate random symbol display device (such as that described in U.S. Pat. No. 5,275,411, but modified to randomly display at least rank selected from either all fifty-two cards or less then all fifty cards, such as only a number and higher, such as sixes or higher, or as only a number or lower, such as nines and lower, depending on whether a minimum or maximum to be discarded or retained is to be displayed) is provided. The indicator has been programmed to randomly display a symbol rank and/or suit or symbols and indicate that cards that are a randomly determined minimum rank must be discarded. In this Example, two cards are provided to each of three players (1, 2 and 3), four cards are provided to the dealer and the player-banker's hand, and three community cards are placed on the table. Each player has made a $10.00 Ante Wager.

The display device is activated, and it randomly identifies that any card with a rank of Jack or higher must be discarded by the dealer. The dealer exposes a first card as a King of Diamonds, and the dealer must discard that first exposed dealer card with a rank higher than or equal to a Jack. A number of game options may come into play at this point. The dealer may be allowed to play with the three hole cards unexposed, may be allowed to play with one more cards subsequently exposed and required to be retained in the dealer's hand, or a second card may have to be exposed and the same or other retention/discard rule is in effect. The latter format will be shown as a preferred variant in this example. A second dealer card is then exposed as the 8 of Spades. According to the rule shown by the display, this card must be retained in the dealer's hand if the discard rule is in effect with the Jack as the discard rank. The dealer then discards one of the dealer's remaining two hole cards, either the top hole card or the bottom hole card according to pre-established rules. The rules may either allow or disallow this second discard to be shown to the table. The dealer plays with the remaining two cards, or in a less preferred variant, the dealer may retain all three cards for use in the play of the game, with or without one of the remaining dealer cards exposed. If the first dealer up-card had not been discarded, the dealer hand could be played with four cards, one dealer down card could be discarded, or two dealer down cards could be discarded. The dealer down cards could be discarded according to rules, such as the topmost card discarded, the two topmost cards are discarded, the bottom-most card is discarded, the topmost and bottom-most card are discarded, the second from the top or second from the bottom card are discarded, or the middle two cards are discarded.

After resolution of the number of cards in the dealer's hand, the players may fold or place additional Play Bets at 1×, 2× or 3× their initial Ante Wager amounts at the option of the player. The dealer's hand and the community cards are then revealed, and the hands resolved according to the rules of poker. If there were a side bet made on the hands by the players, those side bets would also be resolved at this point. An additional variant of the game requires the dealer's hand to qualify with a minimum hand ranking to play. An example of a qualifying hand is a Queen high or better.

Example 4

This game includes an example of the multiple ante bet format of play of the present invention. Rule 1 for discard and retention are in effect and each of the three players is provided with a two-card initial hand, the dealer receives three initial cards as the player-banker's hand, there are three face-down community cards, and in this example, there are no side bet wagers in play, even though possible new games and wagers can be put into play.

The players make Ante and Big Raise Ante wagers as follows:

| | Ante | Big Raise Ante |
|---|---|---|
| Player 1 | $5.00 | $10.00 |
| Player 2 | $5.00 | $20.00 |
| Player 3 | $10.00 | $50.00 |

The dealer's initial up card is a 5 of Clubs. According to Rule 1, this card must be discarded. The play may continue by either a dealer hole card being exposed or not exposed at this point. Solely for purposes of illustration, this example elects to have another dealer card displayed, but this is an optional house rule. The dealer then exposes the 9 of Hearts. There is no discard/retention rule on the second revealed card in this example. The dealer now has only two cards remaining in the dealer hand and will attempt to form a five-card stud poker hand with the three community cards.

Player 1's cards are 7 of Spades and 8 of Diamonds. Player 1 would therefore elect to withdraw one of the ante wagers, most likely, if there is a choice allowed, the $10.00 ante. If he is allowed to stay in the game with withdrawal of one ante, he would have to place a $5.00 Play Wager on the first ante or fold the hand entirely. These are house rule options on play.

Player 2's cards are a pair of two's with a 2 of Diamonds and a 2 of Clubs. He would elect to stay in the game, but this is a relatively weak hand and decides to make a 2× Play Wager on the first ante ($10.00) and a 1× Play Wager on the second ante ($20.00). The player is permitted to play both Antes because he holds a pair or better.

Player 3 has a pair of Queens (Q of Spades and Q of Hearts) and has high confidence in the hand, placing 3× Play Wagers on each of the two antes, for $30.00 and $150.00, respectively).

The dealer then reveals his hole card as a 2 of Spades along with the exposed 9 of Hearts. The community cards are revealed as 2 of Hearts, 9 of Diamonds and Ace of Spades. With this community card set, the final hands become:

| Dealer | Players |
|---|---|
| 2 Pair 9's and 2's | Player 1 - Ace High<br>Player 2 - Three-of-a-kind, three 2's<br>Player 3 - Pair of Queens |

The resolution of this hand of the game would therefore be that Players 1 and 3 lose all of their remaining wagers, and Player 2 is paid 1:1 on both Ante wagers and their respective Play wagers for a total payment of $55.00. If a bonus were in place for high-ranked hands, a bonus multiplier might be applied to the hand rank of three-of-a-kind on the three 2's.

Other Examples

In other examples of the invention, no Play bet is required. For example, the player can make an Ante and Big Raise Ante bet, with no further bets required to stay in the game.

An optional side bet may be permitted that pays odds a fixed jackpot payout or a progressive jackpot payout on the players' hand or partial hand meeting or exceeding a specified rank. For example, when the player is placing this optional side bet, that his initial two card rank is sufficiently strong, he may place a wager up to the house limits for a bonus payout on the following ranked hands:

| Hand | Odds |
|---|---|
| Pair of Aces | 40:1 |
| Pair | 5:1 |
| Straight Flush | 4:1 |
| Straight | 1:1 |

In other examples of the invention, the bonus award is based on the three community cards, the combination of the player cards and community cards, the best three of the player's two cards and three community cards, the dealer's two cards, the dealer's two cards and three community cards or the best three of the dealer's two cards and three community cards. The structure of the bonus payouts and winning hands are necessarily different for 3, 4, 5, 6, 7 and 8 card combinations.

First Preferred Game Example

The preferred game of the present invention has been tentatively named BIG RAISE Poker™ game. One embodiment of the game is described as follows. A single standard 52-card playing card deck is used to play the game. Players place two ante wagers (the wagers may be also be termed play wagers) at the beginning of the game, a first Ante and a second Ante (Big Raise Ante) having a non-limiting exemplary range of 1× to 4× with respect to each other, the ante wagers being placed into a specific location for the first Ante and the second Ante. Players are dealt two cards face down and the dealer is dealt three cards, with one card presented face up and two cards face-down. Three flop cards or community cards are dealt face-down. The object is to eventually make a best multi-card (e.g., 5-card) poker hand in at least a dealer/banker versus player competition. The dealer examines the first single up-card to determine its rank. Dealer first-up cards with a rank of 9 or lower are discarded, and the Dealer plays with the two down cards. Dealer first-up cards with ranks of 10 or higher are kept by the Dealer and a specific position down-card is discarded (probably without display to the table, although display would be allowed). The player may or must withdraw (depending on the House Rule) one of the two wagers unless the Dealer up-card is a King or higher, and then both Antes are required to be kept at risk. The player may or may not be required to place a Play wager in addition to one or more of the two Ante wagers, preferably when required, the requirement applying to only the lower value Ante wager. In one embodiment, only if the player holds a pair or better, is he permitted to make both ante wagers. This is referred to as going "all in". In another embodiment, he is required to go all in with a pair. Otherwise he chooses which ante to play. The community cards are revealed, and each player competes against the dealer in 5-card poker rank with each Ante wager left in the game; The winning players are paid 1:1 on wagers. An optional side bet on various high ranking hands and increasing payout amounts in play (with a bet wager supplemental to the ante wager) is provided.

Second Preferred Game Example

In this form of the game, the maximum payout to any player on any bet is 50:1. Other payouts for lesser raking hands are contemplated. However, the exact payout multiples for specific five-card poker hands are unimportant to the invention. When the player places the Ante and optional Big Raise bets (1× and 1-3×, respectively), and also makes an Aces Up side bet wager, and the side bet wager is won, the player is paid a maximum of 50:1 on the Aces Up bet, plus even money on the Big Raise bet. In another alternate form of the invention, when the player wins the Aces Up bet, for certain high ranking hands (such as a straight flush, for example) the player wins 50:1 on the Aces Up bet and also wins even money on the Ante and Big Raise bets—or whatever ante bets or bets are in play.

In this example of the invention, ties are a push in the game against the dealer. So it would be possible for the player and dealer hands to be equal in rank, but the player's hand is high enough to win the Aces up bet and win 1:1 on the ante and/or big raise bets despite the fact the outcome of the game against the dealer is a push.

The game has three mechanisms to give the house an advantage:

1. The dealer's hand can be improved. If his face-up card is a 9 or less, he gets a chance to get a better card. Allowing the dealer to improve his hand at a time in the game when a player is not allowed to improve his hand.
2. The player is forced to increase or at least maintain the initial two-component player wager under specified conditions. In this case, if the dealer's face-up card is a King or an Ace. The dealer will turn up a King or an Ace 15.4% of the time. This means that when the house has a big expected value, the player is required to play both ante bets. When the dealer's up card is an Ace, he calls "all in" (indicating both Ante's go into play) but keeps all three initial cards, for a total of six cards. He plays his best five cards out of six providing a critical house advantage. When the dealer's up card is a King, he calls "all in" (indicating again that both Ante's go into play) but has to discard a face down card. He plays with a total of five cards.
3. The relative size of the larger ante wager over the other ante wager is limited. The players' ability to make or maintain a larger wager based on more information confers a big advantage to the player. Limiting the size of this advantage is critical to the house.

The three house advantage mechanisms, in combination, slightly offset the obvious player advantage caused by the player's ability to make a bigger bet when he sees good cards, in particular, his ability to go "All-In" with a Pair. One other perspective is that when the player has a big expectation, other than when he has a Pair, he is forced to pull one of his two ante wagers out of play, albeit the smaller of the two. But, when the dealer has a big expectation, the player is forced to place both bets, in some instances, quadrupling the wager. To some degree, this house advantage is offset by the player's ability to wager both of his ante-wagers when he has a Pair.

As noted, the above descriptions and examples are intended to be exemplary of broad and generic scopes of inventions and should not be seen as limiting the scope of the disclosure or the claims. Alternative, additional and optional variations in the play of the game may be made without deviating from the concepts of the present invention as described and as claimed.

What is claimed:

1. A method of playing a player-banked poker card game comprising:

each player placing at least one ante wager to participate in the game;

at least one player receiving a first number of cards as a partial player hand and a dealer receiving a second number of unexposed cards as a partial banker hand, the second number of cards having at least one card more then the first number of cards received by the player, the first number of cards and the second number of cards forming partial player hands and a partial banker hand, respectively;

providing a set of community cards that are used by the banker and the at least one player to complete the partial banker hand and partial player hands;

showing one of the banker's cards to provide a rank of a shown banker card;

compelling the dealer to discard the shown banker's card if the rank of the shown banker's card is within a first range of values and compelling the dealer to discard an unexposed banker's card if the shown banker's card is within a second range of values that is different from the first range of values to determine a rank of the banker's band;

resolving the at least one ante wager according to rules of the poker game, with the dealer and the at least one player forming a multiple-card banker poker hand and multiple-card player poker hands from a) the community cards and banker's cards and b) the community cards and the at least one player's cards, respectively.

2. The method of claim 1 wherein the dealer must discard the shown dealer's card when the shown dealer's card is at or below a predetermined rank, and the dealer must retain the shown dealer's card when the shown dealer's card is above the predetermined rank.

3. The method of claim 2 wherein the dealer must discard the shown dealer's card when the shown dealer's card is at or below a rank of 9 or a rank of 10.

4. The method of claim 2 wherein the player must make a play wager of at least 1× the ante wager after determining the dealer's hand to remain in the game.

5. The method of claim 1 and further comprising the player playing an optional additional Ante wager that may be placed in proportion to the ante.

6. The method of playing a poker game according to claim 1 wherein the at least one player makes at least two independent ante wagers in the poker game:

a player making a first ante wager to participate in the game;

a player making a second ante wager to participate in the same game;

the at least one player receives a first number of cards and a dealer receives a second number of cards, the second number of cards being at least one card more than the first number of cards received by the player, wherein the received cards separately form a part of the player and banker bands;

after the dealer has been compelled to discard the at least one card, allowing the player to withdraw at least one of the at least two ante wagers; and resolving any ante wager still in play according to rules of the poker game, with the dealer and the at least one player forming multiple-card banker hand and multiple-card player poker hands from a) the community cards and the banker's cards and b) the community cards and the at least one player's cards, respectively.

7. The method of claim 6 wherein the dealer must discard the shown dealer's card when the shown dealer's card is at or below a predetermined rank, and the dealer must retain the shown dealer's card when the shown dealer's card is above the predetermined rank.

8. The method of claim 7 wherein the dealer must discard the shown dealer's card when the shown dealer's card is at or below a rank of 9 or a rank of 10.

9. The method of claim 7 wherein the player must make a play wager of at least 1× at least the ante wager after determining the dealer's hand to remain in the game.

10. The method of claim 9 wherein the player has an option of a range of play wagers that may be placed in proportion to the ante that must be placed on the at least one ante to remain in the game.

11. The method of playing a poker game according to claim 1 wherein:

the at least one player makes at least two independent ante wagers in the poker game;

a dealer receives cards and at least one player receiving cards, the cards representing part of a banker's hand and part of a player's band, respectively; and allowing the player under certain conditions to withdraw at least one of the at least two ante wagers, leaving at least one wager remaining in play.

12. The method of claim 11 wherein a number of cards provided to the dealer and player is three and two, respectively, and a first one of the dealer's cards is shown, wherein the dealer must discard the shown dealer's card when the shown dealer's card is at or below a predetermined rank, and the dealer must retain the shown dealer's card when the shown dealer's card is at or above a predetermined rank and discard one of the unexposed cards.

13. The method of claim 12 wherein the dealer must discard the shown dealer's card when the shown dealer's card is at or below a rank of 9 or 10.

14. The method of claim 12 wherein the player must make a play wager of at least 1× the ante wager after determining the dealer's hand to remain in the game.

15. The method of claim 14 wherein the player has an option of a range of play wagers tat may be placed in proportion to the ante that must be placed on the at least one ante to remain in the game.

16. The method of claim 14, wherein the two Ante bets are equal.

17. The method of claim 14, wherein a second Ante bet is limited to 3× a first Ante bet.

18. The method of claim 14, wherein when the condition of the dealer's shown card is an Ace, the player must play both Antes and the dealer retains all dealer cards to play a best five out of six cards.

19. The method of claim 14, wherein when the player's hand is a pair or better, the player is permitted to play both Antes.

20. The method of claim 14, wherein when the dealer's shown card is a King, the player must play both Antes, and the dealer must discard a down card.

* * * * *